US005685367A

United States Patent [19]

Jun

[11] Patent Number: 5,685,367

[45] Date of Patent: Nov. 11, 1997

[54] HEAT EXCHANGER FIN HAVING SLITS AND LOUVERS FORMED THEREIN

[75] Inventor: Hong-Seok Jun, Seoul, Rep. of Korea

[73] Assignee: Samsung Electronics Co., Ltd., Kyungki-do, Rep. of Korea

[21] Appl. No.: 630,581

[22] Filed: Apr. 10, 1996

[30] Foreign Application Priority Data

May 25, 1995 [KR] Rep. of Korea ..... 95-11432 U

[51] Int. Cl.[6] ..... F28D 1/04; F28F 1/32

[52] U.S. Cl. ..... 165/151; 165/181

[58] Field of Search ..... 165/151, 181, 165/182

[56] References Cited

U.S. PATENT DOCUMENTS

| | | | |
|---|---|---|---|
| 4,550,776 | 11/1985 | Lu | 165/151 |
| 4,832,117 | 5/1989 | Kato et al. | 165/151 |

FOREIGN PATENT DOCUMENTS

| | | | |
|---|---|---|---|
| 3406682 | 9/1985 | Germany | 165/151 |
| 110995 | 8/1980 | Japan . | |
| 162134 | 8/1985 | Japan | 165/151 |
| 194293 | 10/1985 | Japan | 165/151 |
| 153496 | 7/1986 | Japan | 165/151 |
| 243289 | 10/1986 | Japan | 165/151 |
| 26494 | 2/1987 | Japan | 165/151 |
| 266391 | 11/1987 | Japan | 165/151 |
| 80597 | 3/1992 | Japan | 165/151 |
| 136692 | 5/1992 | Japan | 165/151 |

*Primary Examiner*—Leonard R. Leo

*Attorney, Agent, or Firm*—Burns, Doane, Swecker & Mathis, L.L.P.

[57] ABSTRACT

A heat exchanger includes a plurality of spaced apart parallel fins through which pipes extend. A fluid flow is passed between the fins in heat exchanging relationship with respect to a heat exchange medium conducted through the pipes. Each fin includes groups of slits formed therein for converting the fluid flow to a turbulent flow. The slits of each group are arranged in a radiant pattern around a respective pipe. Each fin is also formed with vertical louvers disposed upstream and downstream of each pipe with reference to the direction of the fluid flow. Each louver is formed by a bent portion of the fin which is slanted with respect to the plane of the fin to redirect fluid flow from one side of the fin to the other side.

2 Claims, 4 Drawing Sheets

HEAT EXCHANGER FIN HAVING SLITS AND LOUVERS FORMED THEREIN

BACKGROUND OF THE INVENTION

1. Field of the Invention

The present invention elates to a heat exchange of an air conditioner, and more particularly to a heat exchanger having flat fins each provided with slit type grid groups arranged in radiant patterns around respective heat transfer pipes.

2. Description of the Prior Art

A heat exchanger of an air conditioner according to the prior art, as illustrated in FIG. 1, includes a plurality of flat fins 1 arranged in parallel, spaced apart at a predetermined interval, and a plurality of heat transfer pipes 2 arranged perpendicular to the plurality of flat fins 1 and disposed in a zigzag pattern.

At this time, fluid flows through the plurality of flat fins 1 in a direction of the arrow to thereby perform a heat-exchange function with the medium disposed in the heat transfer pipes 2.

At this location, a thermal fluid characteristic around the plurality of the flat fins 1 is that, as illustrated in FIG. 2, a temperature boundary layer 3 where the heat is not properly transferred from the heat transfer pipe 2 on a heat transfer surface of the flat fin 1 gets thicker from a tip end unit of the flat fin 1 to a remote end thereof, so that heat transfer ratio is reduced from the tip end to the remote end, to thereby cause a lowering of the performance of the heat exchanger.

There is another disadvantage in the thermal fluid characteristic around the heat transfer pipe 2 in that, the heat is not properly transferred beyond about 70 to 80 degrees up and down around an axis of the heat transfer pipe 2 when fluid of low speed flows toward the heat transfer pipe 2 in the direction of the arrow, as illustrated in FIG. 3.

In other words, there is generated a void (by way of example, an oblique flow region 4) indicated in oblique lines at the back of the heat transfer pipe 2, to thereby reduce the efficiency of the heat exchanger.

As a prior art, there is disclosed Japanese laid open utility model publication No. Showa 55-110995, where fin 1 of a heat exchanger of an air conditioner is formed with a plurality of slit units *5a, 5b, 5c, 5d, 5e* and *5f* among the plurality of heat transfer pipes 2 as illustrated in FIG. 4.

In other words, the slit units *5a, 5c* and *5e* and the other slit units *5b, 5d* and *5f* are alternatingly protruded from both sides of the flat fin 1 by a cutting process, as illustrated in FIG. 5.

The heat exchanger according to the prior art thus constructed has an advantage over a heat exchanger having no slit units formed thereon.

However, when local heat transfer performances are compared, the heat transfer performance can be satisfactory at the upstream slit units *5a, 5b* because the temperature boundary layer is thinned out.

However, there is a disadvantage in that the heat transfer performance deteriorates at the slit units *5c, 5d, 5e* and *5f* because a void is generated at the back of the heat transfer pipes 2.

There is another disadvantage in that no improved heat transfer efficiency can be expected because air current flowing through the flat fins 1 is not mixed but flows straight.

SUMMARY OF THE INVENTION

Accordingly, the present invention is disclosed to solve the aforementioned problems and it is an object of the present invention to provide a heat exchanger of an air conditioner by which fluid flowing through respective flat fins can be turbulent and mixed, to minimize unavailable void at the back of the heat transfer pipes and to thereby improve the heat exchanger efficiency.

The heat exchanger of an air conditioner according to the present invention employing a plurality of flat fins arranged in parallel in order to allow fluid to flow therethrough and heat transfer pipes insertedly arranged in zigzag patterns up and down the plurality of the flat fins in order to allow the fluid and medium therein to be heat exchanged the heat exchanger comprising:

slit type grid groups formed with a larger sectional area of a portion from which the heat transfer pipe is distanced so that the fluid flowing through the plurality of flat fins can become turbulent and mixed around the heat transfer pipes, and, at the same time, foldedly formed to the flat fins so as to be shaped in radiant patterns around the heat transfer pipes; and first and second louver type grid units foldedly and slantly formed to forward and backward flat fins of respective heat transfer pipes so that the fluid can be guided in flow direction thereof.

BRIEF DESCRIPTION OF THE INVENTION

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
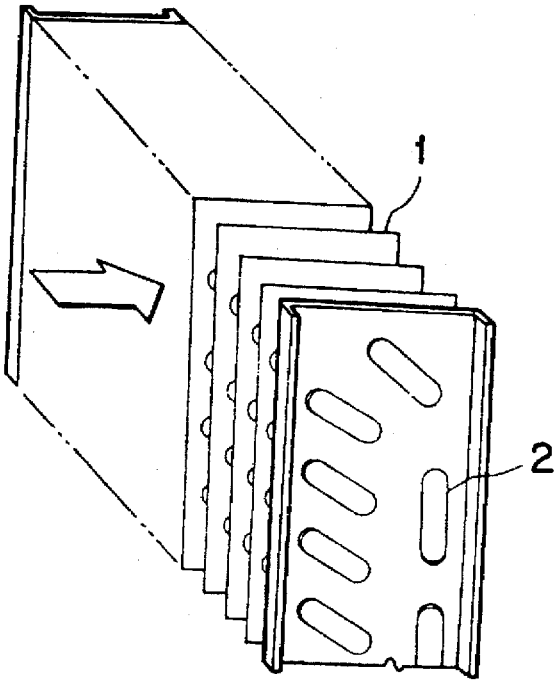
FIG. 1 (PRIOR ART)
FIG. 1 is a perspective view of a heat exchanger according to the prior art.
Figure 2:
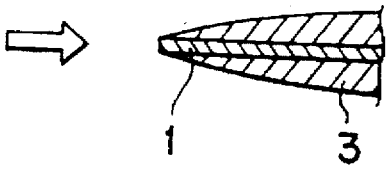
FIG. 2 (PRIOR ART)
FIG. 2 is a descriptive explanation of thermal fluid at the flat fin in FIG. 1.
Figure 3:
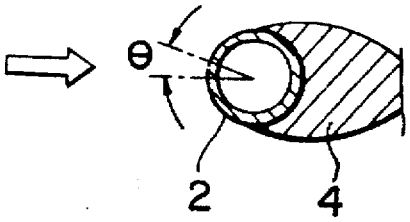
FIG. 3 (PRIOR ART)
FIG. 3 is a descriptive explanation of thermal fluid around the heat transfer pipe in FIG. 1.
Figure 4:
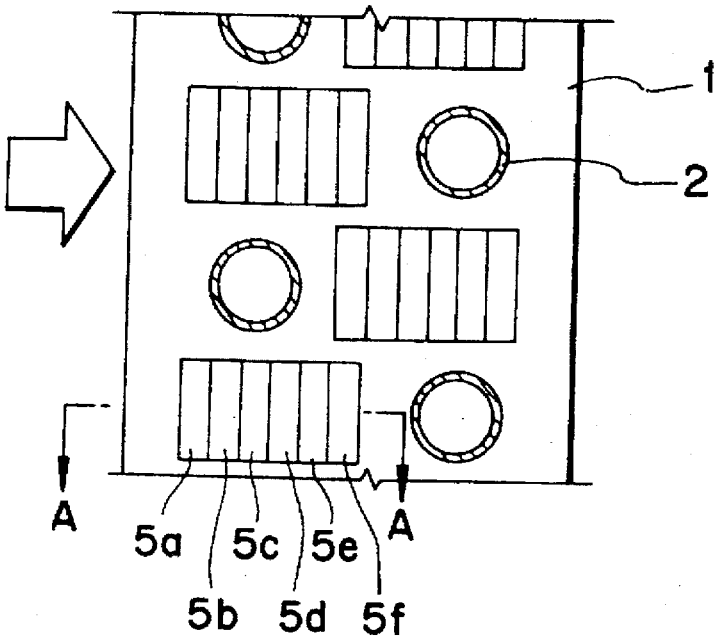
FIG. 4 (PRIOR ART)
FIG. 4 is plan view of another heat exchanger according to the prior art.
Figure 5:
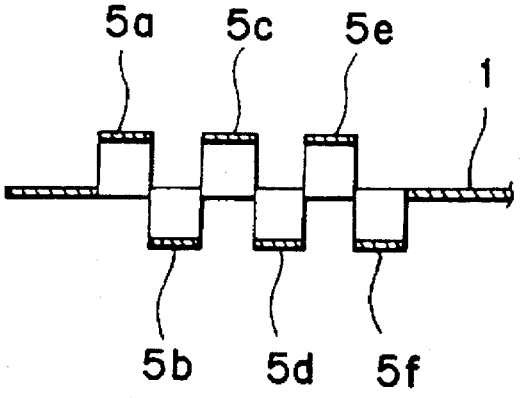
FIG. 5 (PRIOR ART)
FIG. 5 is a sectional view taken along A—A line in FIG. 4.

Throughout the drawings, like reference numerals are used for the designation of like or equivalent parts or portions and redundancy is omitted for simplicity of illustration and explanation.

Figure 6:
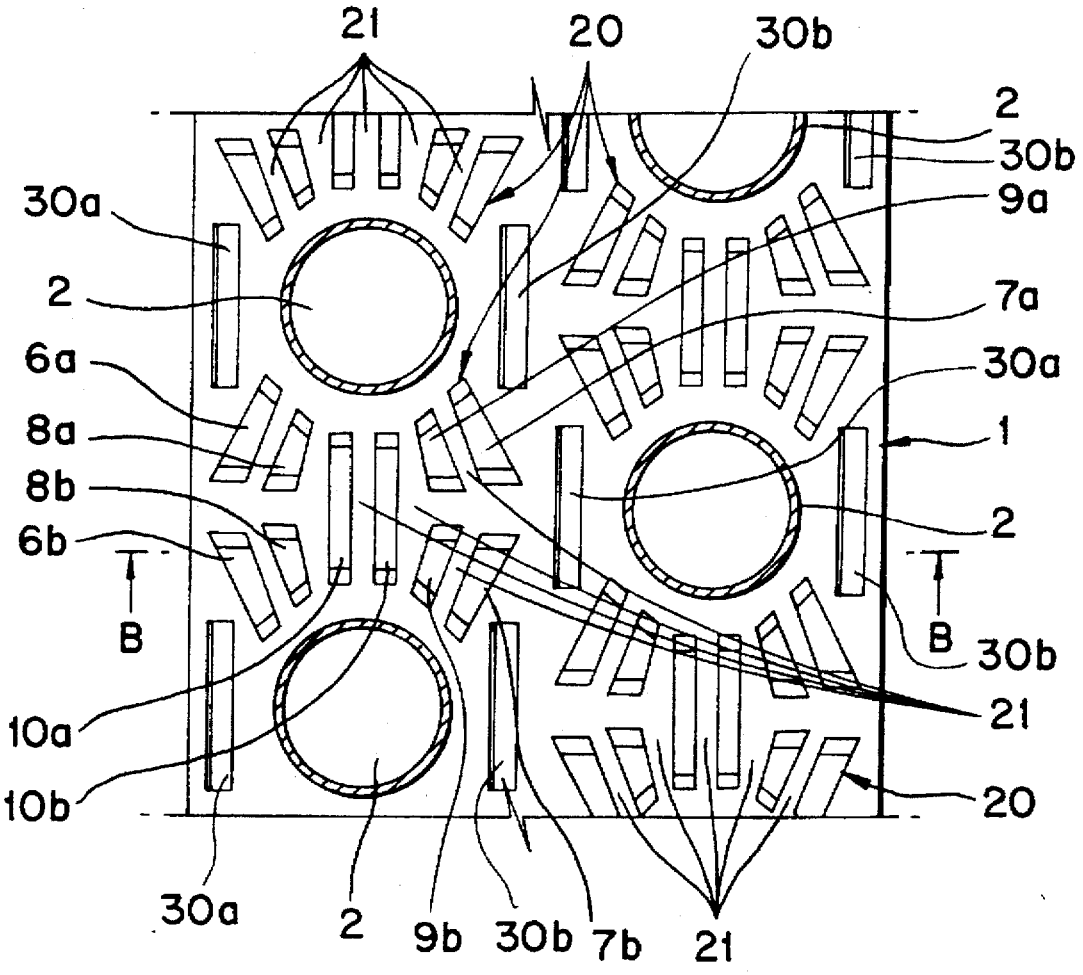
FIG. 6 is a plan view of a heat exchanger according to the present invention.

The heat exchanger according to the present invention, as illustrated in FIG. 6, comprises:

a plurality of flat fins 1 (only one fin shown in FIG. 6) arranged in parallel at a predetermined interval in order to allow fluid to flow therebetween;

heat transfer pipes 2 arranged in a zigzag pattern perpendicular to the plurality of the flat fins in order to allow the fluid and medium therein to be heat exchanged.

slit type grid groups 20 provided so that the fluid flowing between the plurality of flat fins can become turbulent and mixed around the heat transfer pipes, the grid groups arranged in radiant patterns around the heat transfer pipes; and first and second vertical louver type grid units 30*a* and 30*b* disposed in front of and behind of respective heat transfer pipes so that the fluid flowing on both surfaces of each of the flat fins 1 can become turbulent and mixed to thereby minimize the void produced at the back of the heat transfer pipes 2. Each grid unit 30*a*, 30*b* is slanted with respect to the plane of the fin 1 (see FIG. 8).

The slit type grid groups 20 are arranged in a zigzag pattern on both surfaces of each of the flat fins 1, with respective bases 21 (i.e., solid portions) disposed thereamong.

In other words, each of the slit type grid groups 20 comprises:

first and second vertically spaced slit units 6*a* and 6*b* slanted with respect to vertical, to cause the fluid to become turbulent when passing toward front end portions of respective heat transfer pipes 2;

third and fourth vertically spaced slit units 7*a* and 7*b* slanted with respect to vertical, to cause the fluid to become turbulent after passing rear end portions of the heat transfer pipes 2;

fifth and sixth vertically spaced slit units 8*a* and 8*b* disposed downstream of the first and second slit units 6*a* and 6*b* slanted with respect to vertical, to cause the fluid to become turbulent when passing around front portions of the heat transfer pipes 2;

seventh and eighth vertically spaced, slanted slit units 9*a* and 9*b* disposed immediately upstream of the third and fourth slit units 7*a* and 7*b* and slanted with respect to vertical to cause the fluid to become turbulent when passing around rear end portions of the plurality of heat transfer pipes 2; and ninth and tenth vertical slit units 10*a* and 10*b* disposed between the fifth and sixth slit units 8*a*, 8*b* and the seventh and eighth slit units 9*a*, 9*b* to cause the turbulent fluid to be mixed and to reduce the void generated at the back of the plurality of the heat transfer pipes 2.

The space between the first and second slit units 6*a* and 6*b*, and the space between the third and fourth slit units 7*a* and 7*b* are wider than the space between the fifth and sixth slit units 8*a* and 8*b* and the space between the seventh and eight slit units 9*a* and 9*b*, and the areas of the first, second, third and fourth slit units 6*a*, 6*b*, 7*a* and 7*b* are larger than the areas of the fifth, sixth, seventh and eighth slit units 8*a*, 8*b*, 9*a* and 9*b*.

Figure 7:
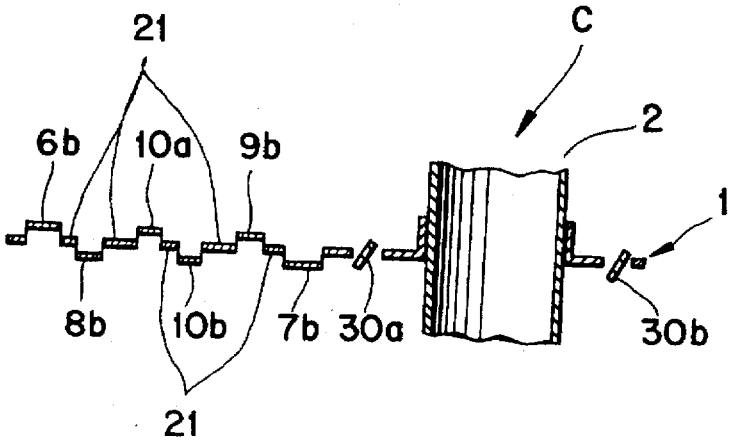
FIG. 7 is a sectional view taken along B—B line in FIG. 6.

Furthermore, the first, second, ninth, seventh and eighth slit units 6*a*, 6*b*, 10*a*, 9*a* and 9*b*, as illustrated in FIG. 7, protrude from one side surface of a flat fin 1 at a predetermined interval, and the fifth, sixth, tenth, third and fourth slit units 8*a*, 8*b*, 10*b*, 7*a* and 7*b* protrude from the other side surface of the flat fin 1 so that the first, second, ninth, seventh and eighth slit units 6*a*, 6*b*, 10*a*, 9*a* and 9*b* are arranged in a zig-zag pattern.

Meanwhile, each of first and second louver type grid units 30*a* and 30*b* protrude from both sides of a flat fin 1 at a predetermined slant or (see FIG. 8) so as to be opened toward a direction from which the fluid flows through the fins.

Figure 8:
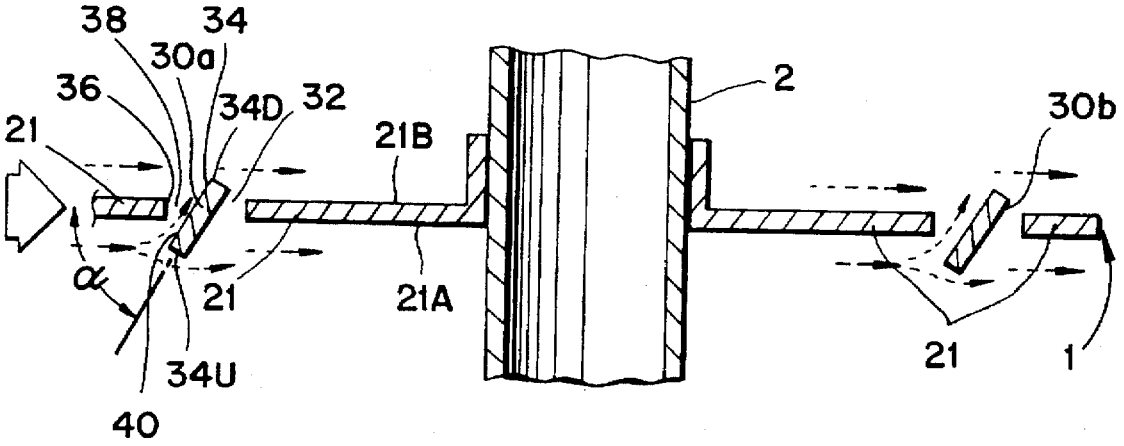
FIG. 8 is an enlarged view of "C" part in FIG. 7.

As shown in FIG. 8, each of the louver type grid units 30*a* and 30*b* is disposed in an opening 32 extending through the respective fin and includes a surface 34 intersecting the plane of the respective fin 21. The surface 4 faces in an upstream direction (i.e., toward the left in FIG. 8) with reference to the direction of air flow S across the fin. The surface 34 is spaced in a downstream direction from an adjacent edge 36 of respective opening 32 to form therewith a passage 38 extending from one side 21A of the fin to the other side 21B. The surface 34 terminates in upstream and downstream edges 34U, 34D. The upstream edge 34U is disposed upstream with respect to the downstream edge 34D. A portion 40 of the surface 34 extends beyond the one side 21A and terminates at the upstream edge 34U to form a deflector which deflects air into the passage.

Next, the operational effect of the present invention thus constructed will be described.

When the fluid flows in direction S in FIG. 8, between the plurality of flat fins 1, the fluid passes through a guide passage formed by the slit units 6*a*, 6*b*, 7*a*, 7*b*, 8*a*, 8*b*, 9*a* and 9*b* to slowly be disturbed, and through the ninth and tenth slit units 10*a* and 10*b* to thereby be divided and converged.

The fluid is then rendered turbulent by the first and second louver type grid units 30*a* and 30*b*, to thereby minimize the void generated at the back of the plurality of heat transfer pipes 2.

In other words, the first, second, ninth, seventh and eighth slit units 6*a*, 6*b*, 10*a*, 9*a* and 9*b* each in two-tier grid group 20 protrude from one side surface of the flat fins 1 in diagonally zigzag patterns with respect to the fifth, sixth, tenth, third and fourth slit units 8*a*, 8*b*, 10*b*, 7*a* and 7*b*, which protrude from the other side surface of the flat fin 1, to thereby be excluded from the temperature boundary layer formed by the fifth, sixth, tenth, third and fourth slit units 8*a*, 8*b*, 10*b*, 7*a* and 7*b*, so that the heat exchange efficiency can be improved.

Furthermore, the slit units 7*a*, 7*b*, 8*a*, 8*b*, 9*a*, 9*b*, 10*a* and 10*b* are formed in radiant patterns around the heat transfer pipes 2, to thereby enable the fluid to become turbulent, and, at the same time, to become diffused, so that the void generated at the back of the heat transfer pipes 2 can be drastically reduced.

Still furthermore, because the cross section of the slit units 6*a*, 6*b*, 7*a*, 7*b*, 8*a*, 8*b*, 9*a* and 9*b* are constructed to become smaller as the slit units approach a respective pipe 2, an improved heat exchange efficiency can be expected even from the spaces between the plurality of heat transfer pipes 2 where the heat transfer phenomenon is usually least realized.

Meanwhile, the first louver type grid unit 30*a* is formed in a diagonal direction, so that the fluid flowing along a surface of the flat fin 1 can be transferred at a high speed to the opposite surface to thereby improve the heat transfer efficiency.

Additionally, the second louver type grid unit 30*b* is also formed in a diagonal direction, so that the fluid flows an opposite surface of the flat fin 1 and passes through the fifth, sixth, tenth, third and fourth slit units 8*a*, 8*b*, 10*b*, 7*a* and 7*b* in that order to thereafter be diffused for minimization of the void generated at the back of the heat transfer pipes 2.

As is apparent from the foregoing description, there is an advantage in the heat exchanger fin according to the present invention, in that slit type grid groups are radiantly formed around a plurality of heat transfer pipes, and, at the same time, the areas of the slit type grid groups become larger as the groups are distanced from the heat transfer pipes, and first and a second louver type grid units are oriented in a diagonal direction at the front and rear sides of the heat transfer pipes, to facilitate the fluid becoming turbulent and to thereby minimize the void generated at the back of the heat transfer pipes.

What is claimed is:

1. A heat exchanger for an air conditioner, the heat exchanger comprising:

a plurality of flat fins spaced apart and arranged in parallel for conducting a fluid flow therebetween;

a plurality of pipes extending through the fins for conducting a heat exchange medium;

slit type grid groups formed in each fin in a space formed between adjacent ones of the pipes for making the fluid flow turbulent, slit type grids of each group arranged in a radiant pattern with respect to a respective pipe, each said slit type grid being of progressively smaller cross section as it approaches the pipe; and first and second louver type grid units formed in each fin and extending substantially perpendicularly to a direction of fluid flow, the first louver type grid unit situated upstream of a respective pipe with reference to the direction of the fluid flow, and the second louver type grid unit situated downstream of the pipe, each louver type grid unit situated in an opening formed through the fin and being slanted with respect to a plane of the fin for conducting a portion of the fluid flow through the opening from one side of the fin to the other side, each said louver type grid unit including a surface intersecting the plane of the respective fin, the surface facing in an upstream direction with reference to the direction of fluid flow across the fin, the surface being spaced in a downstream direction from an adjacent edge of a respective opening to form therewith a passage extending from one side of the fin to the other side, the surface terminating in upstream and downstream edges, the upstream edge disposed upstream with respect to the downstream edge, a portion of the surface extending outwardly beyond the one side and terminating at the upstream edge to deflect fluid into the passage.

2. The heat exchanger according to claim 1, wherein each of the slit type grid groups comprises first and second slit type grids being situated adjacent upstream sides of respective ones of the adjacent pipes and forming a first space between one another, third and fourth slit type grids being situated adjacent downstream sides of the respective pipes and forming a second space between one another, fifth and sixth slit type grids arranged immediately downstream of the first and second slit type grids and forming a third space between one another, respectively, and seventh and eighth slit type grids arranged immediately upstream of the third and fourth slit type grids, respectively, and forming a fourth space between one another, the first and second spaces being substantially equal, the third and fourth spaces being substantially equal, each of the first and second spaces being wider than each of the third and fourth spaces.

* * * * *